US005888095A

United States Patent [19]

Hussaini

[11] Patent Number: 5,888,095

[45] Date of Patent: Mar. 30, 1999

[54] COAXIAL CABLE CONNECTOR

[75] Inventor: Saied Hussaini, Miami, Fla.

[73] Assignee: Rally Manufacturing, Inc., Miami, Fla.

[21] Appl. No.: 581,487

[22] Filed: Dec. 29, 1995

[51] Int. Cl.[6] ..... H01R 9/05

[52] U.S. Cl. ..... 439/584; 439/394

[58] Field of Search ..... 439/394, 427, 439/578, 638, 584, 784

[56] References Cited

U.S. PATENT DOCUMENTS

| | | | |
|---|---|---|---|
| 3,040,288 | 6/1962 | Edlen et al. . | |
| 3,245,028 | 4/1966 | Badger | 439/578 |
| 3,291,895 | 12/1966 | Van Dyke | 439/578 |
| 3,292,117 | 12/1966 | Bryant et al. | 439/578 |
| 3,673,314 | 6/1972 | Zimmerman et al. | 174/88 C |
| 3,804,972 | 4/1974 | Gommons et al. | 174/88 C |
| 3,872,237 | 3/1975 | Eyre et al. | 174/88 C |
| 4,493,946 | 1/1985 | Duret | 174/88 C |
| 4,920,643 | 5/1990 | Wilson | 439/581 |
| 5,217,392 | 6/1993 | Hosler, Sr. | 439/585 |

FOREIGN PATENT DOCUMENTS

| | | | |
|---|---|---|---|
| 3212684 | 10/1983 | Germany | 439/578 |
| 2198894 | 6/1988 | United Kingdom | 439/578 |

*Primary Examiner*—Gary F. Paumen
*Attorney, Agent, or Firm*—Longacre & White

[57] ABSTRACT

An in-line connector for coaxial connectors, which enables two flush cut cables to be spliced together without further cutting of the cable's insulator or outer conductor jacket. A longitudinal connector has an internal concentrically mounted wire connector which contacts the inner wire conductor of each cable to be spliced. A pair of metallic sleeves extend from the conductor and are inserted into each cable to make contact with the woven metallic sheath of each cable. A collapsible sleeve is concentrically mounted to each end of the connector and engages the connector to inhibit relative rotation. A lock nut threadably engages each of the collapsible sleeves to cover the connection and secure each cable to the connector.

7 Claims, 1 Drawing Sheet

COAXIAL CABLE CONNECTOR

BACKGROUND OF THE INVENTION

1. Field of the Invention

The present invention relates to a coaxial cable connector and more particularly to an in-line coaxial cable connector capable of connecting together two flush cut cables suitable for use in radio and video signal transmission.

2. Description of the Prior Art

Currently there are numerous connectors which enable two coaxial connectors to be spliced together. However, these connectors require the cable to be cut such that the insulating cover is cut back to expose the woven metallic sheath. Additionally, the cable must be cut such that the internal wire conductor extends beyond the remaining portion of the cable to contact a female receptive portion of the cable. This cutting requires the skill of an experienced cable layer and often a cut is made too deep or all the way through the cable. Such an improper cut will require an additional cut thus shortening the length of the cable and wasting the portion which was improperly severed. This type of cutting takes an additional amount of time when attempting to splice together two coaxial cables.

For example U.S. Pat. No. 5,217,392 discloses a coaxial cable splice connector comprising outer conductor shells to make contact with the woven metallic sheath of each cable and an inner conductor bore to make contact with the central wire conductor of each cable. However, the cables to be spliced in U.S. '392 must first be cut to peel back the outer insulator member and expose the woven metallic sheath. Additionally, the cable must be cut such that the inner wire conductors extends past the remaining portion of the cable to engage the inner conductor bore.

There is a need to enable two coaxial cables to be spliced together in-line which requires ease of assembly and simple cut of the cables to be spliced without any reduction in the quality of radio or video reception. The present invention attempts to remedy the drawbacks of the prior art and provide a simpler, less expensive device which is easier to assemble and maintains the quality of radio and video reception.

SUMMARY OF THE INVENTION

It is therefore, the principal object of the present invention to provide an improved in-line cable connection suitable for use with a radio or video receptive antenna.

It is also an object of the present invention to allow the simple connection of two coaxial cables which have been simply transversely cut straight through wherein the end of the cable remains flush.

It is also an object of the invention to provide a means to secure a cable to the connector wherein a collapsible sleeve is mounted about the connector and a projection engages the connector to prevent relative rotation.

It is also an object of the invention to provide a coaxial in-line connector which requires no specialized tool other than a simple cutting tool to cut the ends of the cables in order to splice the cables together.

DESCRIPTION OF THE PREFERRED EMBODIMENT

Figure 1:
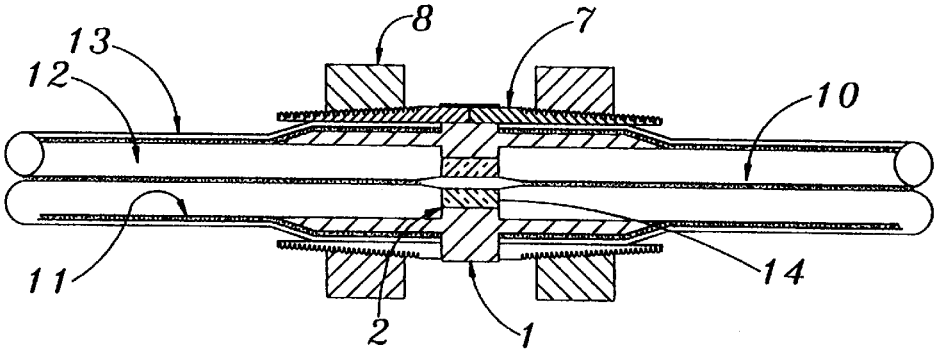
FIG. 1 is a longitudinal sectional view of the in-line connector connecting two coaxial cables.

Referring to FIGS. 1–7 in detail, one embodiment of the cable joint of the present invention is depicted in FIG. 1, showing the joining of two coaxial cables 9. A pair of cables 9 each have an inner conductor 10 concentrically embedded within a dielectric material 12 which is in turn concentrically surrounded by a woven metallic sheath 11 which is in turn is concentrically surrounded by an insulating material 13. The ends of the cables are generally flush cut to define a generally flat transverse area as shown in FIG. 1 at 14. The flush cut end of each cable lies adjacent to an exposed portion of the connector 1 and insulator 2.

Figure 2:
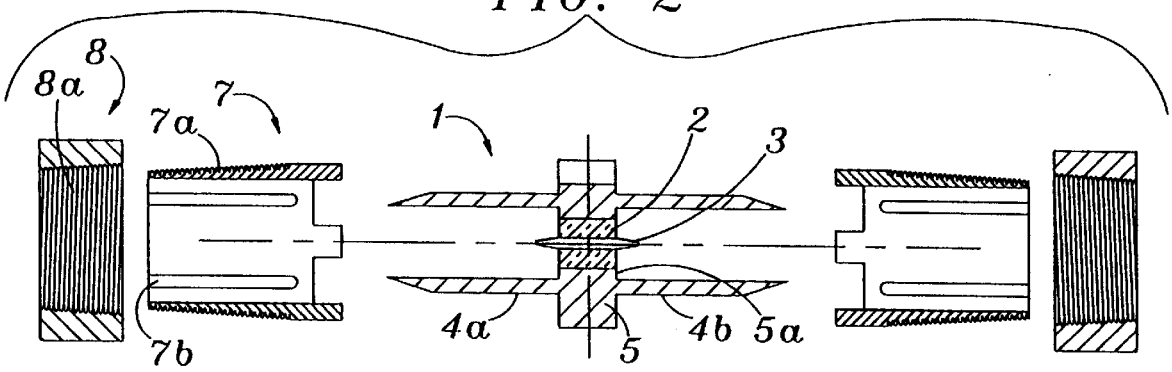
FIG. 2 is an exploded longitudinal sectional view of the in-line connector.
Figure 3:
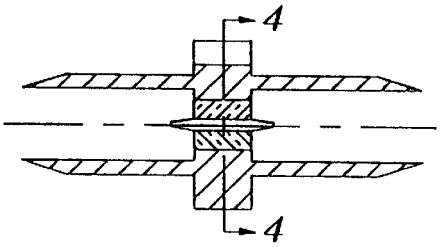
FIG. 3 is a longitudinal sectional view of the interface connector.
Figure 4:
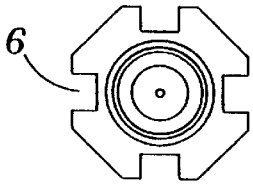
FIG. 4 is a transverse sectional view of the interface connector taken along line 4—4 of FIG. 3.
Figure 5:
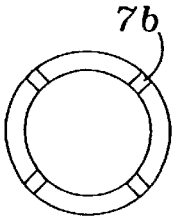
FIG. 5 is an end view of the collapsible sleeve taken along line 5—5 of FIG. 6.
Figure 6:
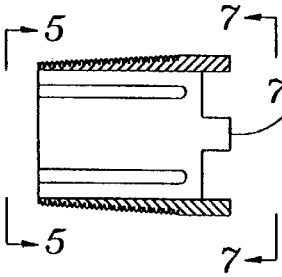
FIG. 6 is a longitudinal sectional view of the collapsible sleeve.
Figure 7:
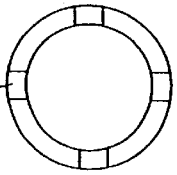
FIG. 7 is an end view of the collapsible sleeve taken along line 7—7 of FIG. 6.

Now referring to FIG. 2, an interface connector 1 has a centrally located nut portion 5 which has an annular inward extending portion 5*a*, the axis of which defines a common longitudinal axis. Within the annular inward extending portion 5*a* of nut portion 5 is coaxially disposed an insulator 2 and a conductor 3. The width of the insulator 2 is substantially equal to the width of the annular inward extending portion 5*a* so as to provide a generally planer or flat exposed surface. The conductor member 3 is of such a width that when centrally disposed within insulator 2 it extends beyond the insulator on both sides. This extended portion of the conductor member 3 provides an exposed surface to contact the inner conductor member 10 of the cables 9 which are to be spliced together. The length that the conductor 3 extends from the insulator is such as to afford a good contact with the inner conductor 10 of the cable 9 while allowing the transverse surface area of the cable to rest next to the generally planar surface defined by the insulator 2 and inwardly extending portion of the central nut portion 5.

From the central nut portion 5 extends a pair of metallic sleeves 4*a* and 4*b*. Sleeves 4*a*, 4*b* are coaxially aligned with the common axis, defined by the axis of the annular extending portion 5*a*, and extend in opposite directions from the central nut portion 5. The diameter of each of the metallic sleeves 4*a* and 4*b* is substantially the same as the diameter of woven metallic sheath 11 of the coaxial cables 9 so as to make good contact therebetween. The diameter of the metallic sleeves 10 can hence be either slightly larger or slightly smaller than the woven metallic sheath 11.

In order to splice two coaxial cables together each cable 9 is completely severed in a direction transverse to its axis to expose a flush end surface. The cable 9 and the interface connector 1 are coaxially aligned and then simply pushed toward one another such that one side of the interface connector is inserted into one of the cables. The cable 9 and connector 1 are displaced toward one another such that the exposed flush surface of the cable rests against or near the generally planar surface defined by the insulator and inward extending portion of central nut 5 as shown at 14. The connector conductor 3 extends into the dielectric material 12 to make contact with the inner conductor 10 of cable 9. The metallic sleeves 4*a* and 4*b* extend into the cable 9 and surround the dielectric material and make contact with the metallic sheath 11 of the cable 9. The diameter of the metallic sleeve is such that it either makes contact with the inner peripheral surface or the outer peripheral surface of the metallic sheath 11 while being disposed within the cable insulator 13. The connection between each of the inner conductors 10 of each cable 9 is made through the conductor member 3 of the interface conductor 1. The connection between the woven metallic sheath 11 of each cable 9 is made through the two metallic sleeves 4*a* and 4*b* and the central nut portion 5 of the interface connector 1. The central nut portion 5 and the metallic sleeves 4*a* and 4*b* are integrally formed of a material such as copper, or the like, to afford a good connection. The connection is thus established between each co-axial cable.

In order to secure the connection of each cable 9 to the interface cable 1, a collapsible sleeve 7 and locknut 8 are provided. At one end of the collapsible sleeve 7 a portion is threaded on its outer peripheral surface 7*a*. Longitudinal slits 7*b* are cut along this threaded portion 7*a* of sleeve 7 so that the threaded portion 7*a* can expand and contract to accommodate cables of varying diameter. At the other end of sleeve 7 extend a plurality of projections 7*c* which extend in the longitudinal direction. Central nut portion 5 of the interface connector has a plurality of longitudinal notches 6 extending along its entire width parallel to the commonly defined axis. These notches 6 correspond to each of the projecting portions 7*c* of the collapsible sleeve 7. Each projection portion 7*c* is inserted into a corresponding notch 6 in order to prevent relative rotation between the interface connector 1 and the collapsible sleeve 7. A lock nut 8 having a threaded internal surface 8*a* threadingly engages the external surface 7*a* of the collapsible sleeve 7 such that as the lock nut 8 is tightened the diameter of the threaded portion of the collapsible sleeve 7*a* is decreased.

The assembly and securement of the connection will now be described. Once each cable 9 has been flush cut, a locknut 8 and then a collapsible sleeve 7 are slid over each cable 9. The collapsible sleeve 7 is disposed over the cable, and consequently over the insulator portion 13 thereof, such that the projecting portions 7*c* extend toward the flush cut end of the cable 9. One end of the interface connector 1 is coaxially aligned with one of the cables 9 and the two are simply urged toward one another such that one end of the interface cable is inserted into the cable. The collapsible sleeve 7 is slid up towards the interface connector 1 until the projecting portions 7*c* of the collapsible sleeve extend into a corresponding notch 6 of the central nut portion to prevent relative rotation therebetween. The lock nut 8 is then slid up to and threadably engages the collapsible sleeve 7. The locknut 8 is tightened so as to reduced the diameter of the collapsible sleeve 7 to crimp the insulator portion 13 of cable 9 against one of the metallic sleeves 4*a* or 4*b*. This crimping action affords a tight friction connection and prevents the cable 9 from dislodging from the interface connector 1. This crimping action additionally, urges the woven the metallic sheath 11 of cable 9 against the external surface of the metallic sleeves 4*a* and 4*b* to afford a better connection therebetween. Once one cable 9 is secured, the same process is repeated for the other cable to the other side of the interface connector 1; a stable in-line electrical connection between each cable has thus been established.

In an alternate method of assembly two longitudinal cuts may be made into the inslator portion 13 to ease the insertion of the metallic sleeves 4*a* and 4*b* within the insulator portion 13 and over the dielectric material 12. These two cuts preferably are spaced 180° apart so as to be opposite one another. The length of these cuts would be sufficient to allow the insulator portion to expand slightly to ease the insertion of the metallic sleeve over the dielectric material 12 and within the insulator portion 13. Additionally, the length of the cuts should not exceed the width of the sleeve 7 so as to ensure that neither the metallic sheath 11 nor the metallic sleeve is exposed to the environment after complete assembly of the connector. When cutting the insulator portion longitudinally, the depth of the cut should not exceed the thickness of the insulator portion in order to preserve the integrity of the woven metallic sheath 11 and dielectric material 12.

While the coaxial cable connector of this invention has been shown and described with reference to a particular embodiment, it will be understood to those possessing skill in the art that various changes to the form and detail may be made therein without departing from the spirit and scope of the invention.

What is claimed is:

1. A connector for connecting together two flush cut coaxial cables, each cable comprising an inner conductor and an outer conductor concentric and spaced apart therefrom, said connector comprising:

an interface connecter having two open ends, each end capable of receiving a cable, and an axial conductor member extending from one open end to the other which contacts each of said inner conductors of each of said cables to form an electrical connection therebetween;

a locking means for securing each cable to said connector including:

a pair of collapsible sleeves each mounted concentrically about one of said cables, said sleeves each having two ends, an externally threaded surface located at one end and at the other end a means to prevent relative rotation between said collapsible sleeve and said connector, and a pair of locknuts having an internally threaded surface each mounted about one of said collapsible sleeves and threadably engaged thereto, wherein when said locknuts are tightened the diameter of said collapsible sleeves is reduced to clamp down on said cable.

2. A connector as recited in claim 1 wherein said means to prevent relative rotation between each said collapsible sleeve and said connector includes;

at least one projection extending from said one end of said collapsible sleeve; and at least one notch formed on said said connector for receiving said at least one projection and preventing relative rotation therebetween.

3. A connector for connecting together two flush cut coaxial cables, each cable comprising an inner conductor and an outer conductor spaced apart therefrom having a dielectric material disposed therebetween and an insulating material concentrically disposed thereabout, said connector comprising:

an interface connector having;

a central nut portion having an external surface and an inwardly extending annular member, having a length, the axis of which defines a common longitudinal axis;

two coaxially aligned metallic sleeves extending in opposite directions from said nut portion and concentric with said common longitudinal axis each having a diameter substantially the same as said outer conductor of said cable;

a conductor member concentrically and longitudinally centrally disposed within and spaced apart from said central nut portion aligned with said common axis, said conductor member having a diameter substantially equal to said inner conductor of said cable and a length greater than said length of said inwardly extending annular member;

an annular insulator disposed between said inwardly extending annular member of said central nut portion and said conductor member providing electrical insulation therebetween;

a pair of collapsible sleeves each mounted concentrically about one of said metallic sleeves, said sleeves each having two ends, an externally threaded surface located at one end and at the other end at least one projection extending into said at least one notch of said nut portion to prevent relative rotation therebetween; and a pair of locknuts having an internally threaded surface each mounted about one of said collapsible sleeves and threadably engaged thereto wherein when said locknut is tightened the diameter of said collapsible sleeve is reduced.

4. A connector as recited in claim 3, wherein said annular insulator has a length substantially equal to said length of said inwardly extending annular member.

5. A connector as recited in claim 3, wherein said central nut portion includes at least one longitudinal notch cut into said external surface.

6. A connector as recited in claim 3, wherein said metallic sleeves and said central nut portion are integrally formed.

7. A connector as recited in claim 5, wherein said insulator of said cable is disposed between said collapsible sleeve and said metallic sleeve, and when said locknut is tightened said insulator is clamped between said collapsible sleeve and said metallic sleeve.

* * * * *